United States Patent [19]

Redford et al.

[11] 4,127,172

[45] Nov. 28, 1978

[54] VISCOUS OIL RECOVERY METHOD

[75] Inventors: David A. Redford, Fort Saskatchewan; Phillip J. Cram, Calgary, both of Canada

[73] Assignee: Texaco Exploration Canada Ltd., Canada

[21] Appl. No.: 837,482

[22] Filed: Sep. 28, 1977

[51] Int. Cl.[2] ..... E21B 43/24

[52] U.S. Cl. ..... 166/261; 166/272

[58] Field of Search ..... 166/261, 272, 256, 303, 166/263, 252, 251

[56] References Cited

U.S. PATENT DOCUMENTS

| | | | |
|---|---|---|---|
| 3,434,541 | 3/1969 | Cook et al. | 166/272 X |
| 3,908,762 | 9/1975 | Redford | 166/263 |
| 3,938,590 | 2/1976 | Redford et al. | 166/272 X |
| 3,976,137 | 8/1976 | Bousaid | 166/272 |
| 3,978,925 | 9/1976 | Redford | 166/261 |
| 3,991,828 | 11/1976 | Allen et al. | 166/261 |
| 3,993,132 | 11/1976 | Cram et al. | 166/261 |
| 3,999,606 | 12/1976 | Bandyopadhyay et al. | 166/261 X |
| 4,006,778 | 2/1977 | Redford et al. | 166/261 |

*Primary Examiner*—Stephen J. Novosad
*Attorney, Agent, or Firm*—Carl G. Ries; Thomas H. Whaley; Jack H. Park

[57] ABSTRACT

Viscous petroleum may be recovered from viscous petroleum-containing formations such as tar sand deposits in a process employing steam and air or a free oxygen-containing gas in the ratio of 0.05 to 0.65 M.S.C.F. per bbl. and a cyclical injection-production program in which first steam or steam and air are injected and fluids are produced without restriction until live steam is produced at the production well, after which steam and air are injected and production throttled to a value less than 50% and preferably less than 20% until the formation pressure at the production well rises to a value between about 60% to 95% of the steam injection pressure, after which fluid production is permitted without restriction and steam and air injection is reduced to a value less than 50% and preferably less than 20% of the original injection rate. The process should be applied to a formation in which adequate communication exists or in which a communication path is first established. The air and steam in the optimum ratio cause a low temperature, controlled-oxidation reaction in the formation. Optimum results are obtained if the pressurization and drawdown cycles are initiated shortly after the beginning of the steam-air injection program, and the process results in substantially increased oil recovery efficiency at all values of steam pore volumes injected.

22 Claims, 1 Drawing Figure

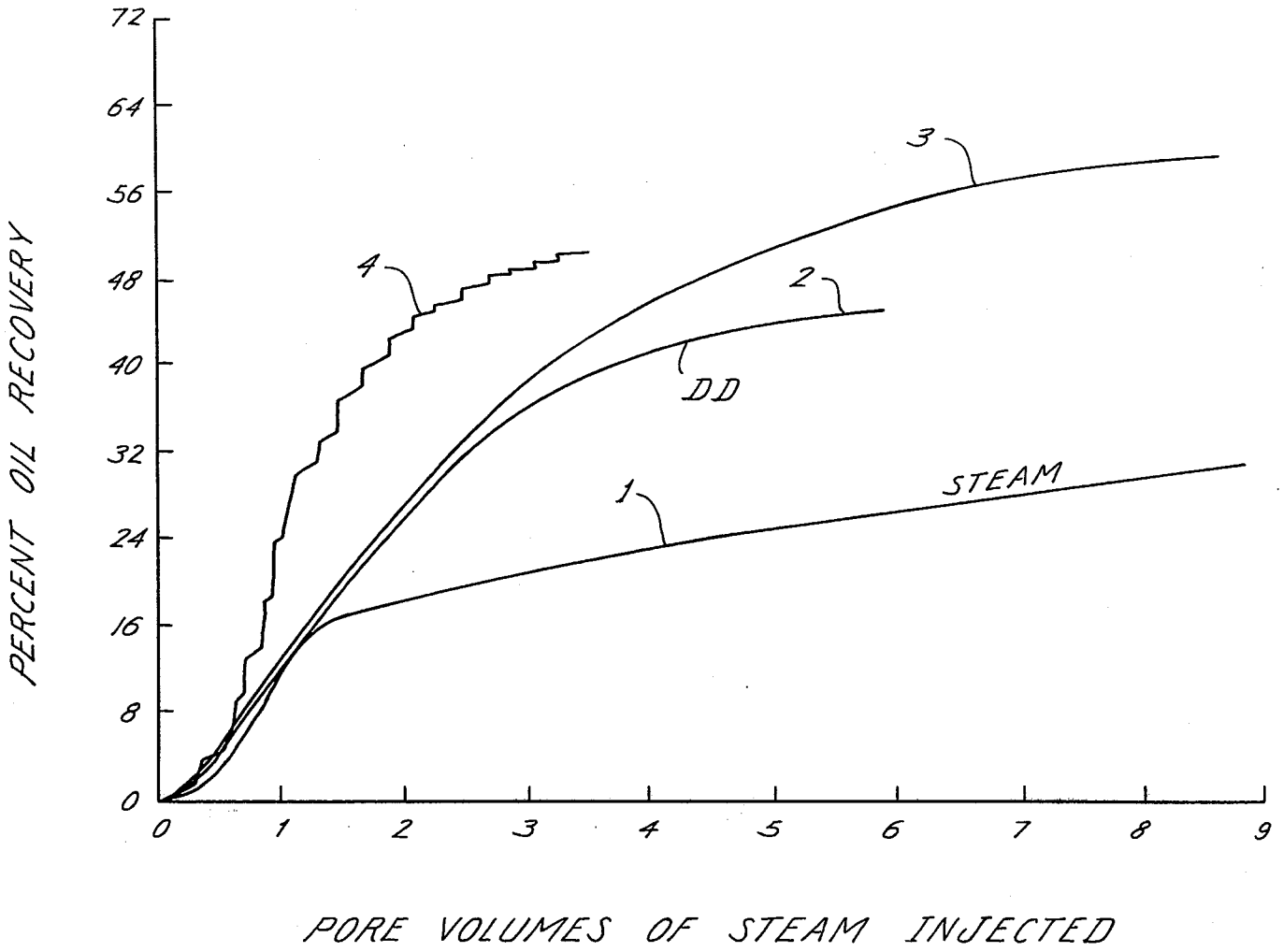
PERCENT OIL RECOVERY
72
64
56
48
40
32
24
16
8
0
0
1
2
3
4
5
6
7
8
9
PORE VOLUMES OF STEAM INJECTED
STEAM
DD
1
2
3
4

VISCOUS OIL RECOVERY METHOD

BACKGROUND OF THE INVENTION

1. Field of the Invention

This invention pertains to an oil recovery method, and more specifically to a method for recovering viscous petroleum from subterranean deposits thereof including tar sand deposits. Still more specifically, this method employs steam and air in a critical ratio to produce a low temperature, controlled oxidation reaction, employing specific injection-pressurization and frequent drawdown cycles, initiated soon after initiating steam and air injection.

2. Description of the Prior Art

There are known to exist throughout the world many subterranean petroleum-containing formations from which petroleum cannot be recovered by conventional means because the petroleum contained therein is so viscous that it is essentially immobile at formation temperature and pressure. The most extreme example of viscous petroleum-containing formations are the so called tar sand or oil sand deposits such as those located in the western portion of the United States, northern Alberta, Canada, and in Venezula. Other lesser deposits are known to exist in Europe and Asia.

Tar sands are frequently defined as sand saturated with a highly viscous crude petroleum material not recoverable in its natural state through a well with ordinary production methods. The petroleum contained in tar sand deposits is generally highly bituminous in character. The sand portion is a fine grain quartz sand coated with a layer of water with viscous bituminous petroleum occupying much of the void space around the water-wet sand grains. A small amount of gas is sometimes also present in the void spaces. The sand grains are packed to a void volume of about 35%, which corresponds to about 83% by weight sand. The balance of the material is bituminous petroleum and water. The sum of the bituminous petroleum and water is usually equal to about 17%, with the bituminous petroleum portion thereof varying from about 2% to about 16%.

The sand grains are tightly packed in the formation in tar sand deposits but are generally not consolidated. The API gravity of the bituminous petroleum ranges from about 5 to about 8, and the specific gravity at 60° F. is from about 1.006 to about 1.027. The viscosity of bituminous petroleum found in tar sand deposits in the Alberta region is in the range of several million centipoise at formation temperature, which is usually about 40° F.

Although some petroleum has been obtained from tar sand deposits by strip mining this is possible only in relatively shallow deposits and over 90% of the known tar sand deposits are considered to be too deep for strip mining at the present time. In situ separation of the bituminous petroleum by a process applicable to deep subterranean formation through wells completed therein must be developed if significant amounts of the bituminous petroleum are to be recovered from the deposits which are too deep for strip mining purposes. The methods proposed in the literature to date include steam injection, in situ combustion, solvent flooding processes and steam-emulsification drive process.

Canadian Pat. No. 1,004,593 describes an oil recovery method once proposed for use in recovering viscous petroleum from the Peace River Oil Sand Deposits in Alberta, Canada described in the July 3, 1974 Edition of the Daily Oil Bulletin, which comprises a steam injection-pressurization program. The process teaches injecting steam for long periods of time while maintaining little or no production, sufficient to build the steam pressure in the formation to a value as high as 800 to 1100 pounds per square inch, followed by a prolonged soak period to effect maximum utilization of the thermal energy injected into the formation in the form of steam, sufficient to reduce the viscosity of substantially all of the oil in the formation to a very low level, such that it will flow readily. Production is then initiated after the injection and soak cycle had been completed, and it is anticipated that several years will be required for completion of each injection period and soak cycle.

U.S. Pat. No. 3,155,160 describes a single well, push-pull steam only injection process employing alternating pressurization and production cycles to maintain pressure in the ever expanding cavity created adjacent the well by oil recovery.

U.S. Pat. Nos. 3,978,925 and 3,976,137 relate to air-steam injection for low temperature, controlled oxidation viscous oil recovery processes.

Despite many proposed methods for recovering viscous petroleum from subterranean viscous petroleum-containing formations including the deep tar sand deposits, there has still been no commercially successful exploitation of deep deposits by in situ separation means up to the present time. In view of the fact there are enormous reserves in the form of viscous petroleum-containing deposits, (estimates of the Athabasca Tar Sand Deposits range upward to 700 billion barrel of petroleum) there is a substantial, unsatisfied need for an efficient, economical method for recovering viscous, bituminous petroleum from deep tar sand deposits.

SUMMARY OF THE INVENTION

We have discovered that viscous petroleum such as the highly viscous, bituminous petroleum found in tar sand deposits may be recovered therefrom in an efficient manner by a process employing a mixture of steam and oxygen or a gaseous mixture including free oxygen, preferably air. The process employs a specific program of formation pressurization and rapid drawdown cycles, and it is preferable that these cycles are initiated early in the life of the steam-air injection program. The steam and air are preferably injected into a formation containing adequate communication between at least one injection well and at least one spaced-apart production well, or a process should be applied to the formation first which insures the establishment of such a communication path, before the steam-air pressurization and early drawdown process of our invention is begun. Once the existence of the communication path is assured, the communication path should be heated by injecting steam or a mixture of steam and air into the communication path and allowing unrestricted flow of fluids from the production well until live steam begins to flow from the production well. After live steam is observed, a mixture of steam and air or other free oxygen-containing gas in a ratio of from 0.05 to 0.65 M.S.C.F/bbl. is injected into the injection well at a pressure less than the pressure which will cause fracturing of the overburden above the tar sand deposit. During this second part of the cycle, production of fluids from the production wells is restricted so as to maintain the pressure in the vicinity of the production well above the vapor pressure of steam, thereby ensuring that only liquids are produced at the production well. The flow rate of fluids flowing from the production well is throttled or restricted to a value less than 50% and preferably less than 20% of the injection volume flow rate. Pressure in the formation adjacent the production well is monitored, and the second part of the cycle is continued until the pressure adjacent the production well rises to a value in the range of from about 60 to about 95% of the pressure at which steam and air are being injected into the injection well. When the pressure at the production well reaches a value of at least 60% and preferably at least 80% of the pressure at which steam and air are being injected into the injection well and the temperature levels of produced fluids are near the saturation temperature of steam at that pressure, at which point some vapor phase steam will begin to be produced at the injection well, the second injection phase of the cycle is terminated. The third part of the cycle involves reducing the injection pressure to a value which will cause the flow rate of steam and air into the formation via the injection well to be reduced to a value less than 50% and preferably less than 20% of the original fluid injection rate. At the same time, the production well is opened and fluids are allowed to flow therefrom at the maximum safe level, choking the production rate only if and to the degree necessary to protect production equipment. The production phase is continued so long as fluids flow from the production well at a relatively high volume rate. Pumping may be utilized during the final portion of the drawdown cycle to increase the fluid production rate. After the flow of fluids from the production well has dropped to a value less than 50% and preferably less than 20% of the flow rate at the beginning of the third phase of the cycle, the third phase is terminated and another cycle essentially identical to the first cycle is initiated. This sequence is continued throughout the remaining life of the flood until the desired oil recovery has been attained.

BRIEF DESCRIPTION OF THE DRAWING

The attached FIGURE illustrates percent oil recovery versus steam pore volumes for a run involving steam, and several runs employing mixtures of steam and air in straight through and in runs employing early initiation of multiple cycles of pressurization-drawdown cycles.

DETAILED DESCRIPTION OF THE PREFERRED EMBODIMENTS

The process of our invention is best applied to a subterranean, viscous oil-containing formation such as a tar sand deposit in which there exists an adequate natural permeability to steam and other fluids, or in which a suitable communication path or zone of high fluid transmissability is formed prior to the application of the main portion of the process of our invention. Our process may be applied to a formation with as little as two spaced-apart wells both of which are in fluid communication with the formation, and one of which is completed as an injection well and one of which is completed as a production well. Ordinarily optimum results are attained with the use of more than two wells, and it is usually perferable to arrange the wells in some pattern as is well known in the art of oil recovery, such as a five spot pattern in which an injection well is surrounded with four production wells, or in a line drive arrangement in which a series of aligned injection wells and a series of aligned production wells are utilized, for the purpose of improving horizontal sweep efficiency.

If it is determined that the formation possesses sufficient initial or naturally occurring permeability that steam and other fluids may be injected into the formation at a satisfactory rate and pass therethrough to spaced apart wells without danger of causing plugging or other fluid flow-obstructing phenomena occuring, the process to be described more fully hereinafter below may be applied without any prior treatment of the formation. Generally, the permeability of viscous petroleum-containing formations is not sufficient to allow direct application of the process of our invention, and particularly in the case of tar sand deposits it will ordinarily be necessary first to apply some process for the purpose of gradually increasing the permeability of all or some portion of the formation such that well-to-well communication is established. Many such methods are described in the literature, and include fracturing with subsequent treatment to expand the fractures to form a well-to-well communication zone such as by injecting aqueous emulsifing fluids or solvents into one or both of the wells to enter the fracture zones in a repetitive fashion until adequate communication between wells is established. In some instances it is sufficient to inject a non-condensible gas such as air, nitrogen or a gaseous hydrocarbon such as methane into one well and produce fluids from the remotely located well until mobile liquids present in the formation have been displaced and a gas swept zone is formed, after which steam may be injected safely into the previously gas swept zone without danger of plugging the formation. Plugging is thought to occur in the instances of steam injection because viscous petroleum mobilized by the injected steam forms an oil bank, moves away from the steam bank into colder portions of the formations, thereafter cooling and becoming immobile at a point remote from the place in the formation in which steam is being injected, thus preventing further fluid flow through the plugged portion of the formation. Unfortunately, once the bank of immobile bitumen has cooled sufficiently to become immobile, subsequent treatment is precluded since steam or other fluids which would be capable of mobilizing the bitumen cannot be injected through the plugged portion of the formation to contact the occluding materials, and so that portion of the formation may not be subjected to further oil recovery operations. Accordingly, the step of developing well-to-well communications is an exceedingly important one in this or any other process involving injection of heated fluids such as steam into low permeability tar sand deposits.

To the extent the horizontal position of the communication channel can be controlled, such as in the instance of expanding a fractured zone into the communication path between spaced apart wells, it is preferable that the communication path be located in the lower portion of the formation, preferably at the bottom thereof. This is desired since the heated fluid will have the effect of mobilizing viscous petroleum located in the portion of the formation immediately about the channel which will drain downward to the heated, high permeability communication path where the viscous petroleum is easily displaced toward the production well. It has been found to be easier to strip viscous petroleum from a portion of a formation located above the communication path than to strip viscous petroleum from the portion of the formation located below the communication path.

The process of our invention comprises a series of cycles, each cycle consisting of three parts. The first part comprises the preheat cycle and may involve injecting steam or a mixture of steam and air or other free oxygen-containing gas into the communication path and allowing fluids to flow through the path and be produced from the production well without restriction so long as only liquids are produced. The first, preheat phase should be ended when live or vapor phase steam production occurs at the production well.

In the second part of the cycle, the mixture of steam and air or other free oxygen containing gas is injected into the injection well or wells and fluid production being taken from the remotely located well or wells is restricted or throttled significantly, in order to increase the pressure in the communication path and the portion of the formation adjacent thereto, as is described more fully below.

Steam should be mixed with a free oxygen-containing gas to accomplish the desired low temperature, controlled oxidation process. Air is ordinarily the preferred free oxygen-containing gas, although oxygen-enriched air or mixtures of oxygen and inert gaseous materials may also be used. For example, a mixture of oxygen with carbon dioxide may be used. On the basis of performance and cost, however, air will usually be the oxygen-containing gas of choice.

The ratio of air to steam should be maintained in the range of from 0.05 M.S.C.F./bbl. to 0.65 M.S.C.F./bbl. (as used above and hereinafter, M.S.C.F./bbl. means thousand standard cubic feet of air or other free oxygen-containing gas per barrel of steam based on liquid water equivalent). The especially preferred range of the ratio of air to steam is from 0.10 to 0.40 M.S.C.F./bbl.

If the oxygen content of the oxygen-containing gas differs materially from the normal oxygen content of air, the ratio should be adjusted accordingly. The free oxygen-steam ratio should be from 0.0125 to 0.13 and preferably from 0.02 to 0.08 M.S.C.F. per barrel of steam.

By injecting the mixture of steam and air (or other free oxygen-containing gas) at the prescribed air-steam ratio into the formation, a low temperature oxidation is caused to occur along the communication path or paths extending through the formation and between injection wells and production wells. The temperature of the low temperature oxidation reaction is maintained in the range of from about 250° F. to about 500° F. Injection is maintained with production being restricted to develop the desired pressure as is described more fully below. During the pressurization phase and the subsequent soak period, if one is used, oxygen is consumed in the low temperature oxidation reaction and the heat generated thereby dissipates from the communication path into the higher oil saturation portions of the formation adjacent to the path. It is a unique characteristic of the low temperature oxidation reaction that relatively less of the crude oil present in the formation is consumed than in the instance of the more conventional high temperature in situ combustion reaction in which air alone is injected and the crude oil ignited, but the temperature-moderating effect of simultaneous steam injection is not present. The difference is especially significant where, as in the present invention, the controlled oxidation process is combined with repetitive cycles of injection with restricted production for pressure development followed by high rate production with greatly reduced injection for drawdown of pressure. Such a process using air injection without steam to moderate reaction temperatures during pressurization would be inefficient and give rise to consuming excessive quantities of formation petroleum. Furthermore, pressure drawdown with near cessation of air injection would, if no steam were injected with air during the next cycle, run the substantial risk of having the controlled oxidation reactions extinguished. A certain amount of heavy bituminous fractions are formed under low temperature oxidation conditions, but this material is not appreciably consumed by the oxygen, and hence that oxygen is able to bypass this deposit largely unreacted and react further in the formation. By this invention the amount of oxygen required to move the front through the formation is significantly reduced. With this type of controlled oxidation reaction, blockage due to excessive carbonization does not occur as it may in processes using high temperature combustion reactions.

An added advantage is that with the visbreaking and mobility improvement ahead of the front, the degraded hydrocarbons are mobile and are transported into the virgin formation where they serve to dilute the in-place hydrocarbons and improve their mobility. This dilution effect extends above and/or below the communication path and aids in stripping viscous oil from the portions of the formation remote from the path.

It is postulated that the oxidation that occurs by the simultaneous use of steam and oxygen-containing gas may be explained in terms of oxidative molecular degradation that is not necessarily a combustion of all of the large asphaltic molecules such as are known to be present in tar sands. The mechanism may be explained in terms of cleavage of asphaltic clusters resulting in a hydrocarbon having a relatively low molecular weight, which has greater mobility. The molecular degradation may result from mild thermal cracking, termed visbreaking.

We have found that this procedure will initiate the low temperature oxidation or controlled combustion without having to use electric downhole heaters, downhole gas burners or chemical ignition methods.

It is necessary that saturated steam be used in combination with the free oxygen containing gas, since the presence of liquid phase water is required to moderate the reaction temperatures and maintain the low temperature oxidation reaction. The preferred steam quality is from 75% to about 95%.

The pressure at which the mixture of steam and air are injected into the formation is generally determined by the pressure at which fracture of the overburden above the formation would occur since the injection pressure must be maintained below the overburden fracture pressure. Alternately, the maximum pressure generation capability of the steam generation equipment available for the oil recovery operation, if it is less than the fracture pressure, may set the maximum injection pressure. It is desirable that the steam and air be injected at the maximum flow rate possible and at the maximum safe pressure consistent with the foregoing limitations. The actual rate of fluid injection is determined by pressure and formation permeability and the steam and air mixture is injected at the maximum attainable rate at the maximum safe pressure.

The optimum degree to which the flow of fluids from production wells is restricted or throttled in the second part of the cycle can be assertained in a number of ways. It is sometimes sufficient to reduce the production flow rate to attain the desired or even maximum fluid production that can be accomplished without production of any vapor-phase steam. Preferably the production flow rate and the pressure in or adjacent to the production well should be monitored, and the rate of flow of fluids from the production well should be restricted to a value less than 50% and preferably less than 20% of the volume rate at which steam and air are being injected into the injection well. The formation adjacent the production well will rise, slowly at first, as the pressure in the formation is increased. When the pressure at the production well rises to a value from 60 to 95% and preferably at least 80% of the pressure at which the mixture of steam and air is being injected into the injection well, the second part of the cycle is completed. For example, if the steam and air injection pressure is 400 pounds per square inch, the fluid flow rate at the production well should be throttled as described above until the pressure in the formation adjacent the production well rises at least 240 pounds per square inch and preferably at least 320 pounds per square inch (60 to 80% of the injection pressure). Ordinarily the pressure will increase gradually as the formation pressure is increased due to the unrestricted steam and air injection and severely restricted fluid flow from the production well; therefore only near the end of the second part of the cycle will the pressure at the production well approach the levels discussed above.

Another method of determining when the second part of the cycle should be terminated involves measuring the temperature of the fluids being produced from the production well, and ending the second part of the cycle when the fluid temperature approaches the saturation temperature of steam at the pressure in the production well. This can sometimes be detected at the end of the second part of the cycle by the production of a small amount of vapor phase steam or live steam from the production well.

When the third part of the cycle is initiated, both injection and production procedures are changed dramatically. The restriction to fluid flow from the production well is removed and the maximum safe fluid flow rate is desired from the production wells. That is to say, the fluid flow from the production well should be choked only if and to the degree required to protect the production equipment and for safe operating practices. At the same time, the injection rate of steam and air is reduced to a very low level, principally to prevent back flow of fluids from the formation into the injection well. Ordinarily the injection rate is reduced to a value less than 50% and preferably less than 20% of the original fluid injection rate. This insures that there will be a positive pressure gradient from the injection well to the production well at all times, but permits the maximum effective use of the highly beneficial drawdown portion of the cycle.

The third phase of the cycle, which is the drawdown portion of the cycle, is maintained so long as fluid continues to flow or can be pumped or lifted from the production well at a reasonable rate. Once the fluid flow rate has dropped to a value less than 50 percent and preferably less than 20 percent of the initial fluid flow rate of the production wells at the start of the third phase of the cycle, the drawdown cycle may be terminated and a second three part pressurization-drawdown steam-air injection cycle started similar to that discussed above. The first part of the cycle, involving steam or steam and air injection for heating the formation, will ordinarily require much less time than in the first cycle because of the residual heat remaining in the formation after the drawdown part of the cycle.

The oil recovery process is continued with alternating cycles comprising heating, pressurization with throttled production followed by drawdown cycles with greatly reduced injection rates until the oil recovery efficiency begins to drop off as is detected by a reduction in the oil/water ratio of produced fluids.

While the foregoing discussion describes injecting a steam-air mixture, it is of course contemplated that the same result can be obtained by simultaneous but separate injection of air and steam so the mixture is formed in the formation near the point where air and steam injection occurs. Similarly, air and steam may be injected in alternating discreet slugs of air and steam to achieve mixing in the formation. The important requirement is introducing a mixture of steam and air into the formation and it is not crucial to our process where the mixture is formed.

In a slightly different embodiment of the process of our invention, an alkalinity agent is introduced into the formation simultaneously with air-steam injection. Ammonium hydroxide or hydroxides of alkali metal, especially sodium hydroxide, potassium hydroxide and lithium hydroxide, are effective for this purpose. The alkalinity agent promotes emulsification of the viscous petroleum, and is especially beneficial in recovering viscous bituminous petroleum such as that found in tar sand deposits. The alkalinity agent is usually introduced in the form of an aqueous solution, as part of the liquid phase of saturated steam. The concentration of alkalinity agent in the liquid phase should be from 0.05 to 5.0 percent and preferably from 0.1 to 0.5 percent by weight. Anhydrous ammonia may be injected in gaseous form into the formation sequentially or simultaneously with the air and steam.

EXPERIMENTAL SECTION

For the purpose of demonstrating the operability and optimum operating conditions of the process of our invention, the following experimental results are presented. The runs to be described more fully hereinafter below were performed in a three-dimensional simulator cell which is a section of steel pipe, 18 inches in diameter and 15 inches long. One inch diameter wells were included in the cell, one for fluid injection and one for fluid production, each well being positioned 3 inches from the cell wall and 180° apart. The top of the cell was equipped with a piston and sealing ring by means of which hydraulic pressure can be imposed on the tar sand material packed into the cells to simulate overburden pressure as would be encountered in an actual formation.

The cell in each run was packed with tar sand material obtained from a mining operation in the Athabasca Region of Alberta, Canada. A clean sand path, approximately ⅛ inch thick and 2 inches wide was formed between the wells to serve as a communication path. The tar sand material was packed tightly into the cell and then further compressed by means of hydraulic pressure applied by the piston on top of the cell until the density and permeability of the tar sand material approximated that present in a subterranean tar-sand deposit.

In the first run, steam (without air) of approximately 100 percent quality was injected into the cell and fluids were produced from the cell by means of the production well on a "straight through" basis, i.e., without the repetitive cycles of steam injection-pressurization with restricted flow until the indicated endpoint is reached followed by rapid production for drawdown purposes with drastically reduced steam injection rate, as is described more fully above. About 9 pore volumes of steam were injected and it can be seen from curve 1 of the figure that only about 30 percent of the oil was recovered even after injecting nine pore volumes of steam. No pressure drawdowns were employed in run 1.

In the second run, a mixture of steam and air at a constant ratio of 0.24 M.S.C.F./bbl. was utilized without pressurization-drawdown cycles until after about 4 pore volumes of steam had been injected into the formation. It can be seen from curve 2 of the figure that slightly over 45 percent of the oil present in the formation was recovered. Toward the latter part of this run, cycles of 20 minute steam injection followed by 20 minute soak periods and 10 minute drain periods were used. Only a slight increase in recovery was noted, showing pressurization and drawdown cycles begun late in the process have little effect on oil recovery effectiveness.

In the third run, a mixture of steam and air was injected, without pressurization-drawdown cycles, the air steam ratio being 0.17 M.S.C.F./bbl. It can be seen that the change in air-steam ratio had little effect on oil recovery until after 3 pore volumes of steam had been injected.

Run 4 employed a mixture of air and steam in a ratio of 0.12 M.S.C.F. per bbl. with drawdown cycles initiated very early in the process, e.g., with less than one-half pore volume of steam injected. Ten minute steam-air injection periods and 30 minute pressure drawdown cycles were used. It can be seen from curve 4 that the oil recovery effectiveness was very substantially improved in the early portions of the recovery cycle, e.g., in the commercially significant interval of 1–4 pore volumes of steam injection. The amount of oil recovery at 2 pore volumes of steam was increased from 24 to 40 percent, a 67 percent improvement, due entirely to the use of repetitive cycles of pressurization and drawdown. Stated another way, the same recovery can be obtained using air-steam injection with pressure drawdowns with significantly less steam than using air-steam injections in a conventional straight through mode. For example, 32% recovery requires slightly over 1 pore volume of steam when pressurization-drawdowns are initiated early in the steam injection cycle, whereas over two pore volumes of steam are required if repetitive cycles of pressurization-drawdown are not used.

The foregoing experimental results amply demonstrate that injecting a mixture of steam and air or other free oxygen-containing gas in the described sequences of injection-pressurization with restricted fluid production followed by reduced fluid injection and essentially unrestricted fluid production from the production well results in substantially improved oil recovery efficiency as compared to use of steam and air without the early pressurization and drawdown cycles. Moreover, we have discovered that the maximum benefit is obtained if the drawdown cycles are initiated at the earliest possible time after the initiation of injecting steam and air into the formation. Specifically the first drawdown should be initiated by the time the first 2 and preferably before the first 1 pore volumes of steam have been initiated.

The reasons for the significant improvement noted above are not totally understood. It is believed that the heating process followed by pressure reduction accomplishes vaporization of certain fluid components of the formation, which may include water films on the formation sand grains as well as lower molecular weight hydrocarbons which are naturally occurring in the formation. Vaporization of these materials results in the volume increase which provides the displacement energy necessary to force heated and/or diluted viscous petroleum from the portion of the formation above the communication path, into the communication path and subsequently through the communication path toward the production well where they may be recovered to the surface of the earth. It is also believed that the employment of the drawdown cycles, particularly when initiated early in the steam and air injection program, accomplish a periodic cleanout of the communication path whose transmissibility must be maintained if continued oil production is to be accomplished in any thermal oil recovery method. it is not necessarily represented hereby, however, that these are the only or even the principal mechanisms operating during the employment of the process of our invention, and other mechanisms may be operative in the practice thereof which are responsible for a significant portion or even the major portion of the benefits resulting from application of this process.

FIELD EXAMPLE

The following field example is supplied for the purpose of additional disclosure and particularly illustrating a preferred embodiment of the application of the process of our invention, but it is not intended to be in any way limitative or restrictive of the process described herein.

The tar sand deposit is located under an overburden thickness of 500 feet, and the tar sand deposit is 85 feet thick. Two wells are drilled through the overburden and through the bottom of the tar sand deposit, the wells being spaced 80 feet apart. Both wells are completed in the bottom 5-foot section of the tar sand deposit and a gravel pack is formulated around the slotted liner on the end of the production tubing in the production well, while only a slotted liner on the end of production tubing is used on the injection well.

The output of an air compressor is connected to the injection well and air is injected thereinto at an initial rate of about 250 standard cubic feet per hour, and this rate is maintained until evidence of air production is obtained from the production well. The air injection rate is thereafter increased gradually until after about 8 days, the air injection rate of 1,000 standard cubic feet of air per hour is attained, and this air injection rate is maintained constant for 48 hours to ensure the establishment of an adequate air-swept zone in the formation.

Eighty-five percent quality steam is injected into the injection well to pass through the air-swept zone, for the purpose of increasing the permeability of the zone and establishing a heated communication path between the injection well and production well which can be utilized in the subsequent process. The injection pressure is initially 350 pounds per square inch, and this pressure is increased over the next five days to about 475 pounds per square inch, and maintained constant at this rate for 2 weeks. Bitumen is recovered from the production well, together with steam condensate. All of the fluids are removed to the surface of the earth, it being desired to maintain steam flow through the formation on a throughput, unthrottled basis in the initial stage of the process for the purpose of establishing a heated, stable communication path between the injection well and production well. The steam serves to heat and mobilize bitumen in the previously air-swept zones, and the mobilized bitumen is displaced toward the production well and then transported to the surface of the earth. Removal of bitumen from the air-swept portion of the formation reduces the bituminous petroleum saturation therein and therefore increases the permeability of a zone of the formation of the lower portion thereof and extending essentially continually between the injection well and the production well. In addition, the communication zone is heated by passing steam therethrough which is desirable preliminary step to the application of the subsequently described process of my invention.

After approximately two months of steam injection without any form of fluid flow restraint, it is determined that an adequately stable, heated communication path has been established, and live steam production at the production well is noted. Air is comingled with the same 85 percent quality saturated steam in a ratio of 0.25 M.S.C.F. per barrel of steam and this mixture is injected into the communication path at an injection pressure of 450 pounds per square inch. Flow of fluids from the production well is restricted by use of a 3/16 inch choke which ensures that the flow rate of fluids from the formation is less than about 40 barrels per day. This is less than 10 percent of the volume flow rate of steam and air into the injection well, which is 450 barrels per day. Pressure at the production well rises gradually over a four month period until it approaches 260 pounds per square inch. The temperature of the fluid being produced through the choke in the production well after four months of injection is approximately 382° F., and a minor amount of live steam is being produced at the production well, which verifies that the end of the first phase of the cycle of the process of my invention has been reached.

In order to accomplish the second portion of the pressurization-depletion cycle of the process of our invention, the steam and air injection pressure is reduced to about 300 pounds per square inch, which effectively reduces the flow rate of steam and air into the injection well to about 40 barrels per day, less than 10 percent of the original volume injection rate. At the same time, the choke is removed from the production well and fluid flow therefrom is permitted without any restriction at all. The fluid being produced from the production well is a mixture of essentially "free" bitumen, comprising bitumen containing approximately 50% water emulsified therein, and an oil-in-water emulsion. The oil-in-water emulsion represents approximately 80 percent of the total fluid recovered from the well, and the free bitumen is easily separated from the oil-in-water emulsion. The oil-in-water emulsion is then treated with chemicals to resolve it into a relatively water-free bituminous petroleum phase and water, which is then treated and recycled into the steam generator.

Production of fluids under these conditions is continued until the flow rate diminishes to a value of about 15 percent of the original flow rate at the start of this depletion cycle, which indicates that the maximum drawdown effect has been accomplished. This requires approximately 120 days. Another cycle comprising steam injection and unrestricted production until live steam is produced followed by steam-air injection cycle with production being curtailed by means of the choke as is described above is then initiated, and the production then continues through a plurality of cycles of heating, injection with restricted production followed by greatly reduced steam and air injection and virtually unrestricted fluid production from the production well. As consequence of application of the process of this invention, no problems associated with bituminous petroleum blockages is encountered and it is calculated that approximately 85 percent of the bituminous petroleum present in the portion of the formation swept by fluids injected into the injection well is this pilot are recovered from the formation.

Thus we have disclosed and demonstrated how the oil recovery efficiency of a controlled oxidation process using air-steam injection may be dramatically improved by utilization of series of cycles, each cycle comprising a first heating phase followed by a pressurization phase in which steam and air are injected at a high rate into the formation with fluid flow being restricted substantially, followed by virtually unrestricted fluid flow from the production well and substantially reduced steam and air fluid injection, for purposes of drawdown of formation pressure. While our invention has been described in terms of a number of specific illustrative embodiments, it should be understood that it is not so limited since numerous variations thereover will be apparent to persons skilled in the art of oil recovery from viscous oil formations without departing from the true spirit and scope of our invention. It is our intention and desire that our invention be limited only by those restrictions or limitations as are contained in the claims appended immediately hereinafter below.

We claim:

1. A method for recovering viscous petroleum from a subterranean, viscous petroleum-containing, permeable formation including a tar sand deposit, said formation being penetrated by at least one injection well and by at least one production well, comprising:

(a) injecting a heating fluid comprising steam into the formation and producing liquids from the formation until vapor phase steam production occurs at the production well;

(b) thereafter injecting into the formation via the injection well, a mixture of steam and a free oxygen-containing gas in a ratio of from about 0.05 to about 0.65 thousand standard cubic feet of oxygen-containing gas per barrel of steam at an injection pressure less than the fracture pressure of the overburden above the viscous petroleum formations, and at a determinable flow rate;

(c) restricting the flow rate of fluids from the production well to a value less than 50 percent of the flow rate of fluids being injected into the injection well;

(d) determining the formation pressure in the vicinity of the production well;

(e) continuing injecting steam and free oxygen-containing gas into the injection well and producing fluids from the production well at a restricted value until the formation pressure adjacent the production well is equal to a value from about 60 to about 95 percent of the fluid injection pressure at the injection well;

(f) thereafter increasing the fluid production rate to the maximum safe value and simultaneously reducing the injection rate of steam and free oxygen-containing gas into the injection well to a value less than 50 percent of the original rate at which steam and free oxygen-containing gas were injected into the injection well; and (g) continuing production of fluids from the production well at a high rate and injecting steam and free oxygen-containing gas into the injection well at a reduced rate until the flow rate of fluids from the production well drops to a value below 50 percent of the initial fluid flow rate of step (f).

2. A method as recited in claim 1 wherein the ratio of free oxygen-containing gas is from about 0.10 to about 0.40 standard cubic feet of gas per barrel of steam.

3. A method as recited in claim 1 wherein the ratio of free oxygen to steam is from 0.0125 to 0.13 thousand standard cubic feet of oxygen per barrel of steam.

4. A method as recited in claim 1 wherein the ratio of free oxygen to steam is from 0.02 to 0.08 thousand standard cubic feet of oxygen per barrel of steam.

5. A method as recited in claim 1 wherein the free oxygen-containing gas is air, oxygen or a mixture of oxygen with air, nitrogen, carbon dioxide, or mixtures thereof.

6. A method as recited in claim 1 wherein the flow of fluids from the production well is restricted to maintain the fluid flow rate from the production well at a value less than 20% of the rate at which steam and free oxygen-containing gas are being injected into the injection well.

7. A method as recited in claim 1 wherein steps (a) through (g) are repeated for a plurality of cycles.

8. A method as recited in claim 1 wherein an alkalinity agent is mixed with the steam.

9. A method as recited in claim 8 wherein the alkalinity agent is ammonium hydroxide, sodium hydroxide, potassium hydroxide, lithium hydroxide or a mixture thereof.

10. A method as recited in claim 8 wherein the steam is saturated and comprises a gaseous and a liquid phase and the alkalinity agent is dissolved in the liquid phase of steam in a concentration of from about 0.05 to about 5.0 percent by weight.

11. A method for recovering viscous petroleum from a subterranean, viscous petroleum-containing, permeable formation, including a tar sand deposit, said formation being penetrated by at least one injection well and by at least one production well, comprising:

(a) forming a high permeability fluid communication path in the formation extending essentially continually between the injection well and the production well;

(b) injecting a heating fluid into the communication path to raise the temperature thereof to a predetermined value;

(c) injecting into the heated communication path a mixture of steam and a free oxygen-containing gas in a ratio of from about 0.05 to about 0.65 thousand standard cubic feet of gas per barrel of steam via the injection well at an injection pressure less than the fracture pressure of the overburden above the viscous petroleum formations, and at a determinable flow rate;

(d) restricting the flow rate of fluids from the production well to a value less than 50 percent of the flow rate of fluids being injected into the injection well;

(e) determining formation pressure in the vicinity of the production well;

(f) continuing injecting steam and free oxygen-containing gas into the injection well and producing fluids from the production well at a restricted value until the formation pressure adjacent the production well is from 60 to 95 percent of the fluid injection pressure at the injection well;

(g) thereafter increasing the fluid production to the maximum safe value and simultaneously reducing the injection rate of steam and free oxygen-containing gas into the injection well to a value less than 50 percent of the original injection rate at which steam and free oxygen-containing gas were injected into the injection well;

(h) continuing production of fluids from the production well at a high rate and injection steam and free oxygen-containing gas into the injection well at a reduced rate until the flow rate of fluids from the production well drops to a value below 50 percent of the initial fluid flow rate of step (g), and (i) repeating steps (c) through (h) at least once.

12. A method as recited in claim 11 wherein the ratio of free oxygen-containing gas to steam is from about 0.10 to about 0.40 standard cubic feet of gas per barrel of steam.

13. A method as recited in claim 11 wherein the free oxygen-containing gas is air.

14. A method as recited in claim 11 wherein the steam is saturated and the steam quality is from 75% to 95%.

15. A method as recited in claim 11 wherein the free oxygen-containing gas is oxygen or a mixture of oxygen with air, nitrogen, carbon dioxide and mixtures thereof.

16. A method as recited in claim 11 wherein the flow of fluids from the production well is restricted to maintain the fluid flow rate from the production well at a value less than 20% of the rate at which steam and free oxygen-containing gas are being injected into the injection well.

17. A method as recited in claim 11 wherein an alkalinity agent is injected with the steam.

18. A method as recited in claim 17 wherein the alkalinity agent is a hydroxide of ammonia, sodium, potassium, lithium or a mixture thereof.

19. A method as recited in claim 17 wherein the steam is saturated and the alkalinity agent is present in the liquid fraction of steam in a concentration from about 0.05 to about 5.0 percent by weight.

20. A method of recovering viscous petroleum from a subterranean, permeable, viscous petroleum-containing formation penetrated by at least one injection well and by at least one production well, both wells being in fluid communication with the formation, comprising:

(a) fracturing the formation adjacent each of the wells, said fractures being in the lower portion of the formation and extending at least part of the distance between the wells;

(b) injecting a viscous petroleum-mobilizing fluid into the fracture zone adjacent at least one of said wells and recovering said fluid and petroleum from said fracture to increase the permeability of the formation;

(c) repeating step (b) to form a high permeability communication path between said wells;

(d) injecting a heating fluid comprising steam into said communication path via one well and recovering fluids from the communication path by the other well until the temperature of the communication path has risen to a preselected value;

(e) injecting steam and a free oxygen-containing gas at a ratio of from about 0.05 to 0.65 thousand standard cubic feet of gas per barrel of steam into the preheated communication path via the injection well at a predetermined pressure less than the fracture pressure of the overburden;

(f) determining the flow rate at which steam and free oxygen-containing gas are being injected into the formation via the injection well;

(g) restricting the flow rate of fluids being produced from the formation via the production well to a value less than 50 percent of the flow rate of fluids being injected into the injection well;

(h) determining formation pressure in the vicinity of the production well;

(i) reducing the injection rate of steam and free oxygen-containing gas into the injection well when the formation pressure adjacent to the production well is from 60 to 90 percent of the injection pressure at the injection well, to a value less than 50% of the original injection rate; and simultaneously;

(j) increasing fluid production rate from the production well to the maximum safe value;

(k) continuing step (j) until the rate of fluid flow from the production well has declined to a value below 50 percent of the value at the beginning of step (j); and (l) repeating steps (c) through (j) for a plurality of cycles.

21. A method of recovering viscous petroleum from a permeable, subterranean, viscous petroleum-containing formation penetrated by an injection means and a production means, comprising:

(a) injecting a heating fluid into the formation and recovering liquids from the formation until live steam is produced from the formation via the production means;

(b) injecting a mixture of steam and a free oxygen-containing gas at a ratio of from about 0.0125 to about 0.13 thousand standard cubic feet of oxygen per barrel of steam into the formation at a predetermined pressure below the fracture pressure of the overburden via the injection means;

(c) restricting the fluid production rate via the production means sufficiently to ensure production of substantially all liquids with no vapor phase steam;

(d) determining the temperature of fluids being produced from the formation via the production means;

(e) reducing the rate of injecting steam and free oxygen-containing gas into the formation when the temperature of the produced fluids approaches the saturation temperature of steam at the injection pressure to a value less than 50% of the original fluid injection rate; and simultaneously;

(f) increasing the rate of fluid flow from the production means to the maximum safe value;

(g) continuing step (e) until the flow rate of fluids from the formation drops to a value below 50% of the original value; and (h) repeating steps (a) through (f) at least once.

22. A method of recovering viscous petroleum from a permeable, subterranean, viscous petroleum-containing formation penetrated by an injection well and a production well, comprising:

(a) injecting air into the formation via the injection well and recivering air from the formation via producing well to form an air swept zone in the formation;

(b) injecting steam into the air swept zone of the formation and recovering viscous petroleum from the formation to convert the air swept zone into a heated, permeable communication path;

(c) injecting a mixture of air and steam in a ratio of from about 0.05 to about 0.65 thousand standard cubic feet of air per barrel of steam into the communication path at a pressure less than the overburden pressure;

(d) producing fluids from the formation at a rate below 50 percent of the fluid injection rate;

(e) increasing the rate of fluid production to the maximum safe value when vapor phase steam production from the formation via the production well begins; and simultaneously;

(f) reducing the rate at which air and hydrocarbons are injected to a value less than 50% of the injection rate of steps (a).

* * * * *